US005931435A

United States Patent [19]

Hoadley et al.

[11] Patent Number: 5,931,435

[45] **Date of Patent: *Aug. 3, 1999**

[54] PACKAGING AND DISTRIBUTION SYSTEM FOR ROLLED OR CYLINDRICAL ARTICLES

[75] Inventors: Craig Alexander Hoadley, Decatur; Thomas Neal McDowell, Killen, both of Ala.

[73] Assignee: Champion International Corporation, Stamford, Conn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/723,670

[22] Filed: Sep. 30, 1996

[51] Int. Cl.[6] ..... B65D 19/00

[52] U.S. Cl. ..... 248/346.03; 108/55.3

[58] Field of Search ..... 248/346.03, 346.02, 248/154; 108/51.1, 55.1, 55.3, 52.1, 55.5; 206/386, 597, 599, 395, 397, 408

[56] References Cited

U.S. PATENT DOCUMENTS

| | | | |
|---|---|---|---|
| D. 256,346 | 8/1980 | Annis | D9/99 |
| D. 385,080 | 10/1997 | Schueneman et al. | D34/38 |
| 2,803,363 | 8/1957 | Hutchinson | 108/55.3 |
| 2,923,512 | 2/1960 | Campbell | 108/55.5 |
| 3,472,363 | 10/1969 | Rustin, Jr. et al. | 206/597 |
| 3,753,407 | 8/1973 | Tilseth | 108108/55.5 |
| 4,195,732 | 1/1980 | Bell | 206/391 |
| 4,694,962 | 9/1987 | Taub | 206/386 |
| 4,757,900 | 7/1988 | Misset et al. | 206/597 |
| 4,796,540 | 1/1989 | Pelfrey | 108/55.3 |
| 4,826,015 | 2/1989 | Mandel | 206/597 |
| 5,080,314 | 1/1992 | Moyer et al. | 248/346.01 |
| 5,170,721 | 12/1992 | Troth et al. | 108/51.1 |
| 5,193,700 | 3/1993 | Lyman et al. | 206/386 |
| 5,413,054 | 5/1995 | Collins | 108/55.5 |
| 5,515,977 | 5/1996 | Lambert | 206/597 |

*Primary Examiner*—Ramon O. Ramirez
*Assistant Examiner*—Anita M. King
*Attorney, Agent, or Firm*—Richard C. Stewart, II

[57] ABSTRACT

This invention relates to a pallet having a cradle which centers cylindrical articles or materials wound in rolls on the pallet and which allows the rolls to be transported while in a rollingly oriented manner, such that the cradle cooperates with retaining bands extending from a cylindrical core of the article or rolls to notches in runners which are attached to and extend the entire length of the pallet, thereby, securing the rolls in place during transport and storage.

31 Claims, 4 Drawing Sheets

PACKAGING AND DISTRIBUTION SYSTEM FOR ROLLED OR CYLINDRICAL ARTICLES

SPECIFICATION

FIELD OF INVENTION

This invention relates to an improved pallet for use in loading, storing and transporting cylindrical articles or other material wound in rolls, such as rolls of paper.

BACKGROUND OF THE INVENTION

This invention is generally directed to a packaging design for cylindrical articles or material wound in rolls on pallets, in particular, a pallet based design incorporating a pallet having a cradle and notches in runners of the pallet for receiving bands for packaging and distributing the cylindrical or rolled articles. The rolls are shipped on pallets and are rollingly oriented so that the roll may be easily rolled on to and off of the pallets, but is held non-destructively and securely in place during shipment of the roll.

In the past, pallets have been used to transport cylindrical articles or rolled materials. Often the articles were transported while lying flat, not rollingly oriented. However, if delicate material such as paper is being transported, shipments of the rolls lying flat on their edges are not appropriate because the edges lying on the pallet can get damaged either through surface contact or merely by virtue of the pressure created by the weight of the roll or any other rolls placed on top of a bottom roll. Likewise, the top edge could be damaged by another roll on top of it or by contact with handling equipment or other pallets during loading, shipping or unloading.

To limit damage to the article being transported, cylindrical articles or material wound in rolls began to be shipped while oriented rollingly. However, it is unacceptable to merely use a flat pallet because, absent any securing means, the cylindrical article placed in a rolling orientation would simply roll off the pallet.

There are other packaging designs which attempt to overcome the problem of flat pallet based designs. Examples of such other designs are embodied in U.S. Pat. No. 5,515,977 to William E. Lambert and U.S. Pat. No. 5,170,721 to William L. Troth et al. However, in such designs, in addition to a pallet and retaining bands or straps, additional components are often used.

For example, wedges or chocks are used to package and distribute paper or other materials wound in rolls and shipped on pallets. Blocks or materials, such as wood, paper or polymer, used as wedges or chocks and placed between the upper support surface of the pallet and the base of the cylindrical article are used to keep the article from rolling during transport. The wedges or chocks may, however, cut into delicate material and cause damage thereto. Further, the wedges or chocks must be secured to the pallet and are often incorporated with pallet pads, which adds to the complexity of such designs. The wedges or chocks and pallet pads also make the pallets more bulky and more difficult to transport for reuse and cause more difficulty when removing the article from the pallet.

In addition, these wedges or chocks protrude above the pallet deck and must be removed prior to unloading the rolls. These extra components (pads and wedges or chocks plus a means for securing the chocks or wedges) are discarded after the rolls of paper or other material wound in rolls have been removed from the pallets, and, thus, create unnecessary waste which must be disposed.

Other designs have attempted to use a cradle to transport material wound in rolls, but like the designs utilizing wedges or chocks, the cradle protrudes above the pallet deck, thus making a more bulky design. Also, in such designs, in order to unload the rolls, the pallet must be equipped with a detachable wall which allows the article to be unloaded. These detachable walls must have some securing and/or hinging mechanism which adds to the complexity of such designs. In addition, such securing or hinging mechanism can also be the source of problems associated with wear and tear.

Accordingly, there is a need to provide an improved packaging design which maintains the cylindrical article or the material wound in rolls in a rolling orientation, where the article's cylindrical core is horizontal. More specifically, there is a need to package the rolls with a design comprising as few components as possible, but still securely fastening the roll in a condition for transport and storage, and without damaging the stock prior to use by a consumer.

SUMMARY OF THE INVENTION

It is the primary objective of this invention to provide an improved packaging design which maintains cylindrical articles or material wound in rolls in a rolling orientation. More specifically, it is an object of this invention to provide a package for rolls with a design comprising as few components as possible, but still securely fastening the roll in a condition for transport and storage, and without damaging the stock prior to use by a consumer.

A further object of this invention is to provide an improved packaging design incorporating a pallet to be used for transporting and storing cylindrical articles or material wound in rolls, such as paper or cloth, in which the pallet is designed to minimize damage to the article or material during transport and storage, and to reduce excessive deformation of delicate material due to transfer of its weight to the supporting structure of the pallet deck.

Still a further object of this invention is to provide an improved packaging design which facilitates easy removal of the cylindrical articles or material wound in rolls which is transported and stored on the pallet. In addition, there is a need to limit the amount of waste produced from the packaging after the articles or rolls are unpackaged and removed from the pallet.

The above mentioned objectives are attained by this invention which is directed to a protective roll cradle pallet for transporting and storing cylindrical articles or material wound in rolls while rollingly oriented on a pallet. This pallet includes a cradle in the deck of the pallet, preferably along the center of the deck of the pallet, for supporting and cushioning the article or roll being transported, as well as restraining the article from rolling

BRIEF DESCRIPTION OF THE DRAWINGS

The present invention will be understood and appreciated more fully from the following detailed description, taken in conjunction with the accompanying drawings in which.

DETAILED DESCRIPTION OF THE PREFERRED EMBODIMENTS

By way of example, the present invention is illustrated in terms of a design for use in packaging rolls of paper. The design of which a preferred embodiment is illustrated herein may be used in a number of different applications which would be obvious to those skilled in the art. The following examples are provided for the purpose of aiding in explaining the present invention and should nor be construed as a limitation thereon.

Figure 1:
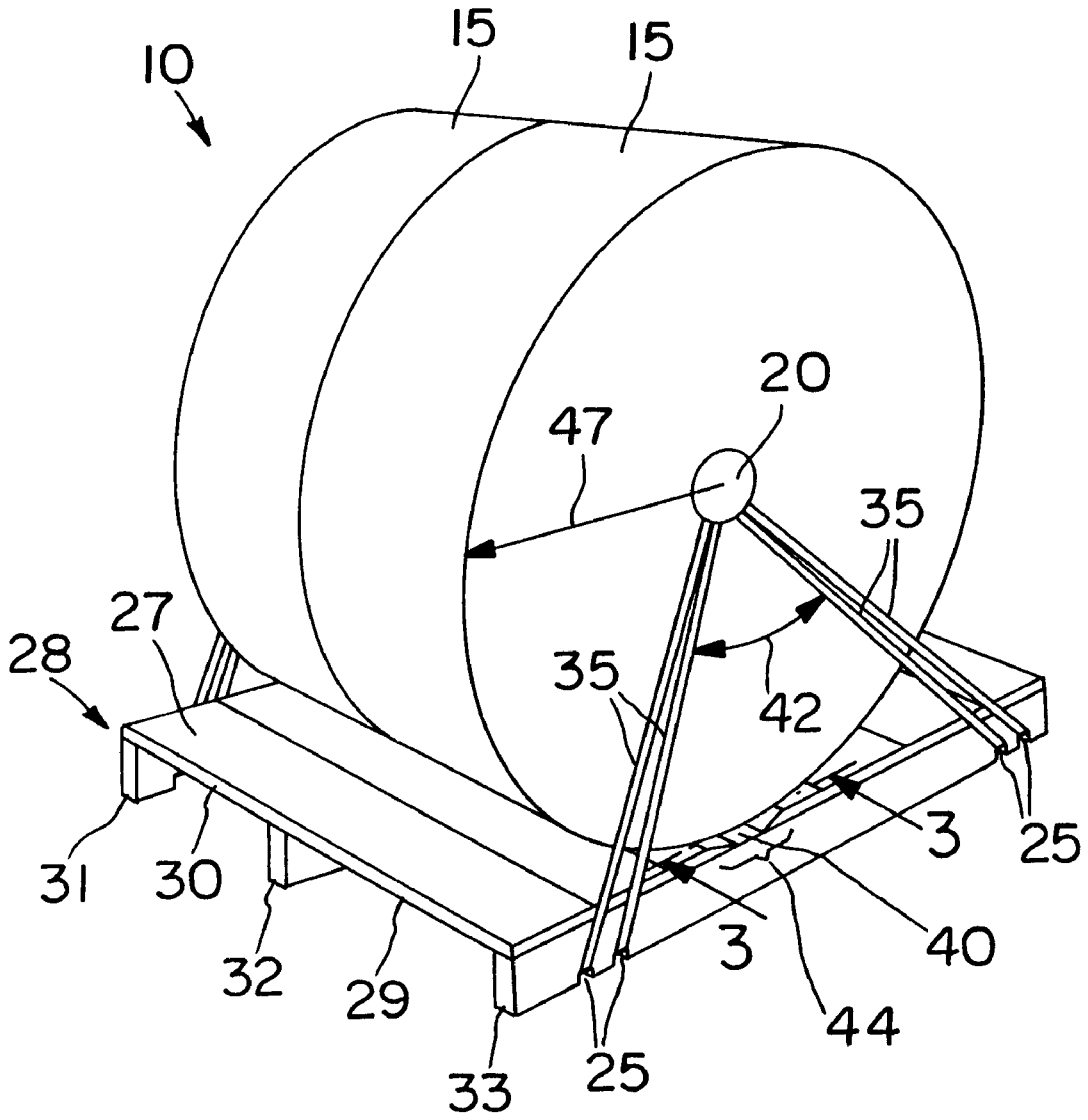
FIG. 1 is a perspective view of a preferred embodiment of this invention.

Shown in FIG. 1 is a general diagram of a preferred packaging design 10 embodying the present invention which allows the distribution and shipping of rolls of paper, or other materials wound in rolls, rollingly oriented on a pallet and prevents rolling by the roll 15 of paper or damage to the paper during transport and storage. In addition, the packaging design 10 allows for easy removal of one or more rolls 15 by merely rolling the roll 15 of paper off the pallet after it has been unpackaged. For the application of paper, typically one to about five rolls are loaded adjacently along a common axis on the pallets.

Figure 2:
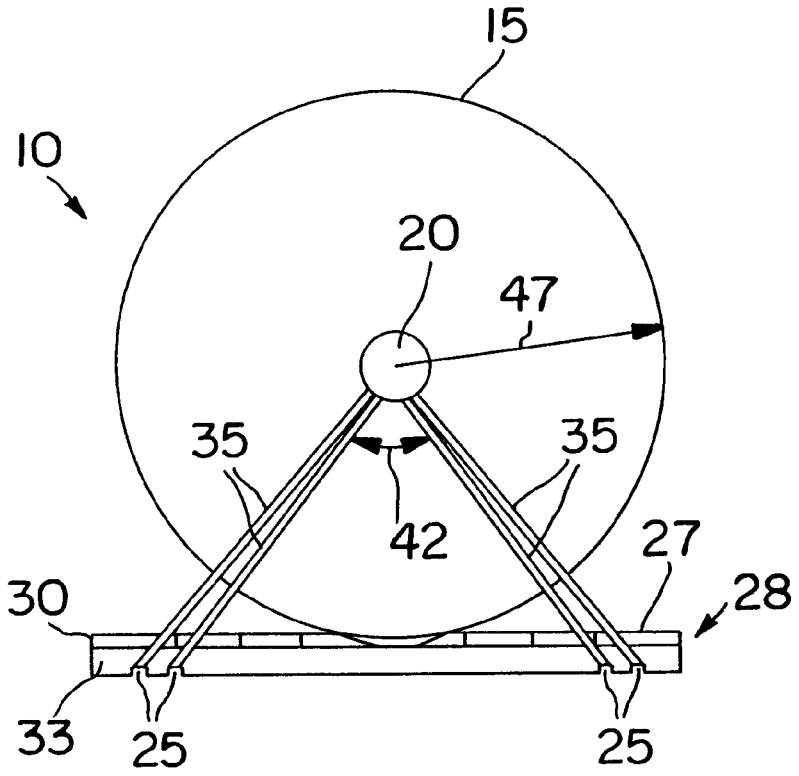
FIG. 2 is a side view of the embodiment of FIG. 1.
Figure 4:
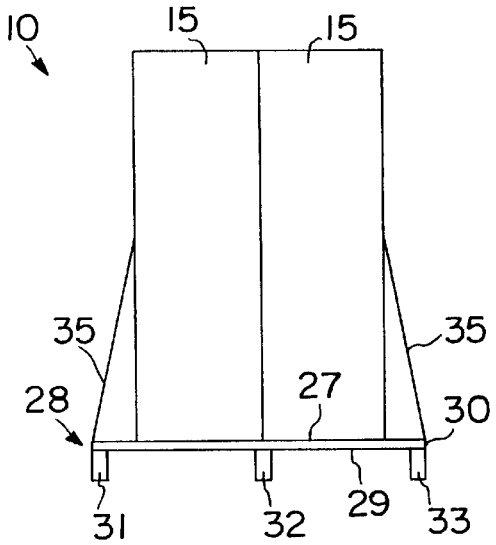
FIG. 4 is a front view of the embodiment of FIG. 1.

A roll cradle pallet for supporting objects is generally shown in FIGS. 1, 2 and 4. The pallet 28 as illustrated, generally is a heavy duty pallet which comprises a deck 30, preferably made of wood planks, having a top surface 27 and bottom surface 29, and a plurality of runners 31, 32, 33 which are parallel to one another and attached to the bottom surface 29 of the deck 30, which extend in a direction perpendicular to the axis of the core 20 of the roll 15 of paper. The plurality of runners 31, 32, 33 extend for the entire length of the pallet 28. Two of the runners 31, 33 are attached to the deck 30 at its opposing outermost edges, thereby forming two exterior runners 31, 33. The runners 31, 32, 33 extend along bottom surface 29 of the deck 30 and raise the top surface 27 of the deck 30 above ground level. The arrangements of the runners 31, 32, 33 beneath the deck 30 is intended to allow two-sided access beneath the pallet 28 by a lifting apparatus. Thus, the runners 31, 32, 33 can be of any thickness, provided that they allow access by a lifting means such as a fork lift.

Figure 3:
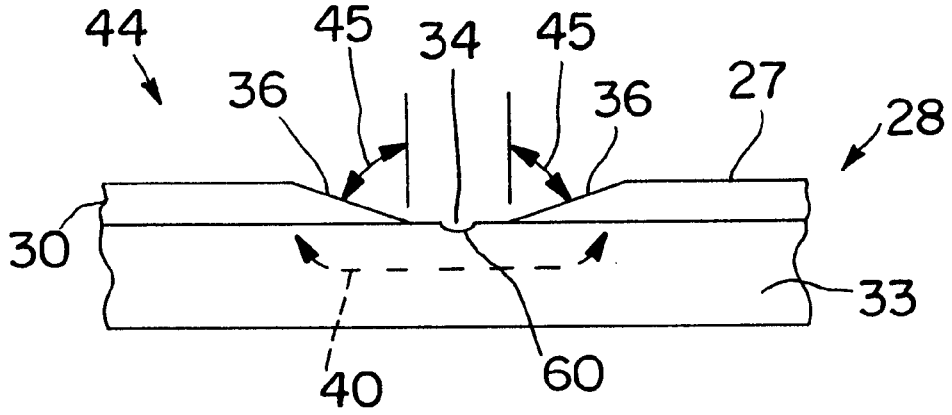
FIG. 3 is a section view of the cut-out section of the pallet of FIG. 1 substantially on the line 3.3 of FIG. 1.

The deck 30, as shown in FIGS. 1 through 3, has a deck cut-out section 44, which forms a cradle 40 for deterring rolling of the roll 15 during transport or storage. The deck cut-out section 44, which forms the cradle 40, is formed in the center of the deck 30 and preferably extends the entire width of the deck 30 in a direction parallel to axis of the core 20 of the roll 15 of paper. The cradle 40 deters the roll 15 from rolling off the pallet 28 during transport or storage. In addition, because the cradle 40 is shallow, it provides easy unloading of the roll 15 after transport and prior to use by a consumer. When removing the roll 15, a relatively small force enables the roll 15 to be simply rolled off and easily removed from the pallet 28.

The cradle 40 as shown in FIGS. 1, 2, and 3, runs along the center of the deck 30 extending the entire length of the deck in a direction parallel to the core 20 of the roll of paper 15, in other words, in a direction perpendicular to the runners 31, 32, 33. As shown in FIG. 3, the cradle is formed by making a cut, preferably about two inches in width for typical rolls of paper stock, extending the entire length of the cradle 40 such that a gap 34 is formed. The cut which forms the gap 34 preferably is cut to a depth equal to the thickness of the deck 30. In addition, two angled cuts, preferably approximately about two inches in width for typical rolls of paper stock, extending from each edge of the gap angled and in opposite outward directions, the cradle angle 45, to the top of the deck, are made which form side walls 36 of the cradle 40. Alternatively, the side walls 36 may be formed as curved, rather than straight, walls. Curved side walls preferably have a radius equal to that of the radius 47 of the roll 15. Also, the runners 31, 32, 33 may optionally include a runner cut-out section 60, dimensioned in accordance with the dimensions of the deck cut-out section, for further forming the cradle 40 for securing the roll 15.

Optimally, the cradle angle 45 is selected to allow the side wall to be substantially tangential to the surface of the roll 15. In other words, the side walls 36 are perpendicular to the radius 47 of the roll 15. Thus, the side walls 36 acts as continuous chocks which evenly distribute the weight of the roll 15 over the entire width of the roll 15. This weight distribution minimizes damage to the paper or material wound in rolls due to the weight of the roll 15 itself.

The runners 31, 32, 33 may also be optionally notched to accommodate a retaining or strapping means for securing the roll. As shown in FIGS. 1 and 2, the exterior runners 31, 33 are provided with notches 25 at each end of each of the exterior runners 31, 33, allowing the roll 15 to be secured to the pallet 28 by a tying means 35, such as straps, bands or the like, which run through the notches 25 and continue through the core 20 of the roll 15 of paper. The notches do not have to be straight, and may further be made to accommodate the roll 15, such as by through-cuts made from a band saw.

Figure 5:
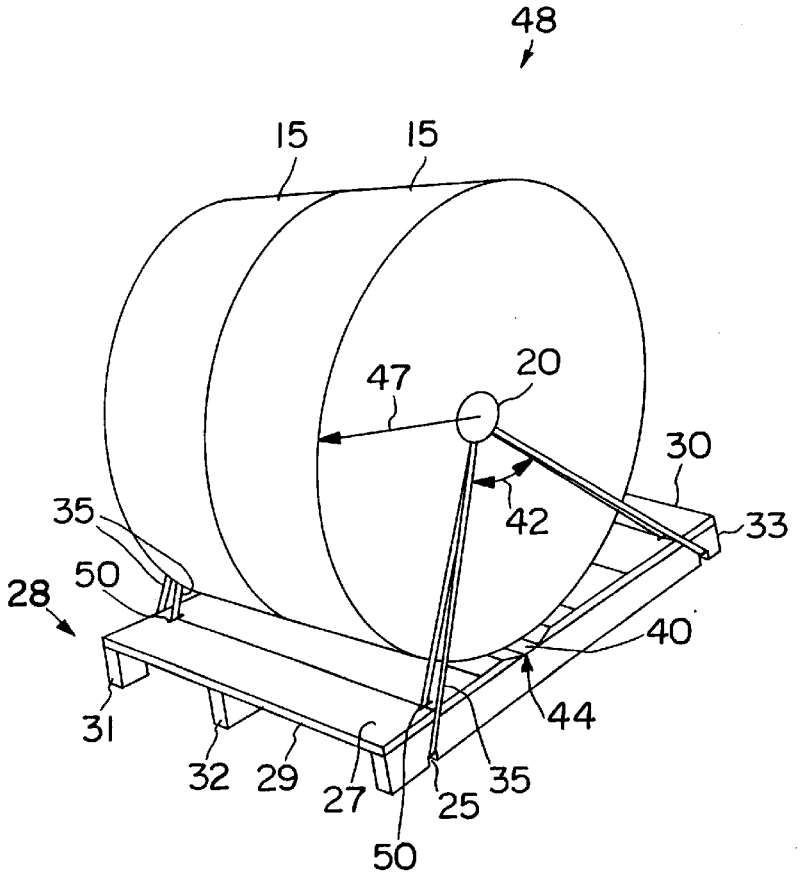
FIG. 5 is a perspective view of another preferred embodiment of this invention.
Figure 6:
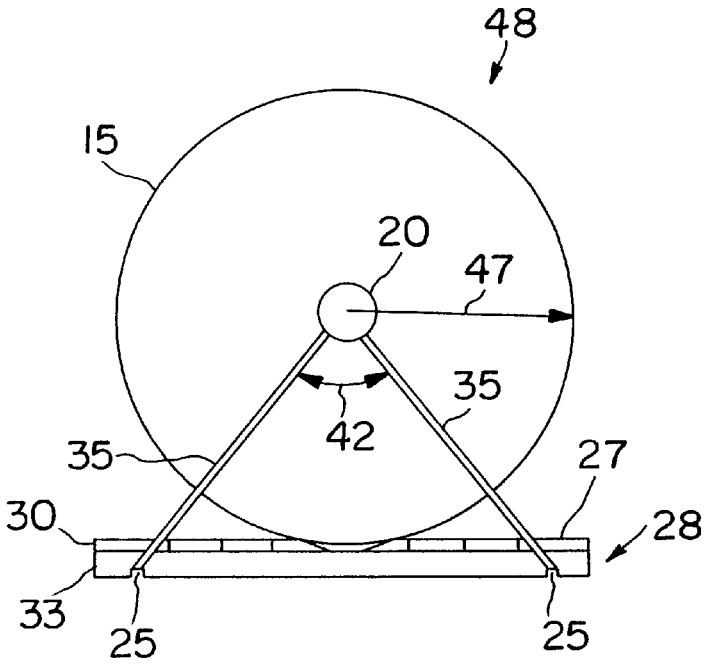
FIG. 6 is a side view of the embodiment of FIG. 5.
Figure 7:
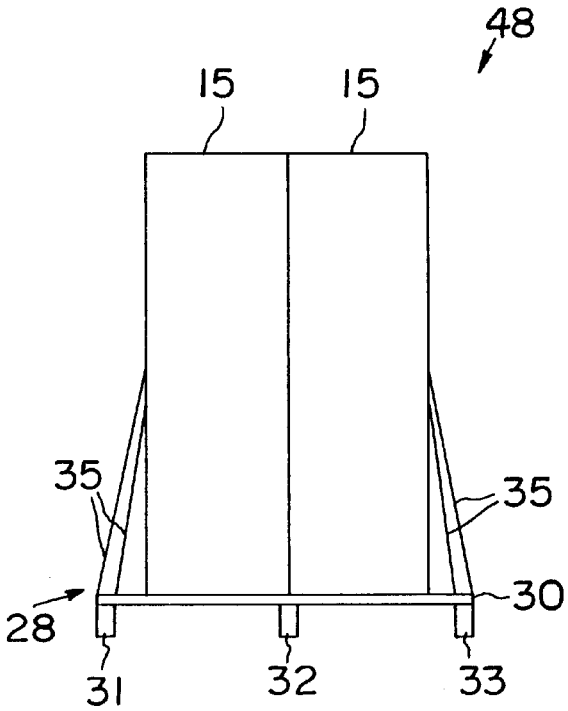
FIG. 7 is a front view of the embodiment of FIG. 5.

In the embodiment of FIGS. 1 to 3, a pair of notches 25 are employed proximate an end of each of exterior runners 31 and 33, and tying means 35 runs through each of these notches 25 under deck 30 and continues through core 20 of the roll 15 of paper. An alternative and preferred embodiment 48 is depicted in FIGS. 5, 6 and 7. As shown in these figures, a single notch 25 is employed proximate each end of exterior runners 31 and 33. Deck 30 further comprises opening(s) 50 associated with each notch 25. Openings 50 may be formed by any convenient means as for example by drilling or cutting a hole in deck 30. In the embodiment 50 depicted in FIGS. 5, 6 and 7, opening 50 is formed by openings formed by abutting edges of the planks forming deck 30. As depicted in FIGS. 5, 6 and 7, tying means 35 run under exterior runners 31 and 33 through each of notches 25 and up and adjacent to the inside of the runners 31 and 33 through openings 50 and continue through core 20 of the roll 15 of paper.

The notches 25 on each exterior runner 31, 33 are preferably placed equidistant, or substantially equidistant a sufficient distance from the cradle 40 to provide a safe banding angle 42 to assure that the roll 15 of paper is secured in place during shipment. The interior runner 32 may also be notched in accordance with the exterior runners 31, 33. Preferably, a safe banding angle 42 is approximately between about thirty and about ninety degrees. Each pallet is optimally designed so the cradle angle 45 and banding angle 42 are in accordance with the radius 47 of the roll 15, i.e., notches 25 are located at a distance from each other approximately equal to the diameter of the roll 15, and the banding angle is, as is shown in FIGS. 1 and 2, about sixty degrees.

The above embodiments are provided only for the purposes of explaining the applicant's invention and it will be appreciated by those skilled in the art that the applicant's invention is not limited to what has been particularly shown and described hereinabove. Further, it will be apparent to those skilled in the art that various modifications and variations could be made in the present pallet without departing from the scope or spirit of the invention. For example, it will be obvious to those skilled in the art that the dimensions of the pallet may be varied to store and transport a plurality of adjacent cylindrical or rolled articles having cylindrical cores whose axes are disposed in a substantially horizontal plane. In addition, it will be obvious to those skilled in the art that any cylindrical article or material wound in rolls, such as wound sheet metal, plastic film, paperboard, woven and non-woven fabric and the like, may be substituted in place of rolls of papers described herein.

What is claimed is:

1. A pallet for transporting and storing at least one cylindrical article having a given diameter, radius and length, said cylindrical article further having a cylindrical core, said pallet comprising:

a plurality of runners, said runners being spaced apart in a substantially parallel relationship, each of said runners having a top edge and a bottom edge; and a wooden planar deck having a wooden bottom surface attached to said top edge of said runners, said deck having a planar wooden top surface spaced from said bottom surface and substantially parallel thereto, said deck further having a deck cut-out section cut into said upper surface of said deck, extending between said top and bottom surfaces, the width of said cut-out section at or near the upper surface of said deck being equal or greater than to the width of said cut-out section at or near the bottom surface of said deck, said deck cut-out section forming a cradle for receiving said cylindrical article, said deck cut-out section extending in a direction substantially perpendicular to said runners for the length of said cylindrical article.

2. The pallet of claim 1 wherein said wooden deck is formed from wood planks.

3. The pallet of claim 1 wherein said cut-out section is shallow.

4. A pallet for transporting and storing at least one cylindrical article having a given diameter, radius and length, said cylindrical article further having a cylindrical core, said pallet comprising:

a first runner and a second runner, said first runner and said second runner being spaced apart in a substantially parallel relationship, each of said first runner and said second runner having a top edge and a bottom edge; and a wooden planar deck having a wooden bottom surface attached to said top edge of said first and second runners, said deck having a planar wooden top surface spaced from said bottom surface and substantially parallel thereto, said deck further having a deck cut-out section cut into said upper surface said of deck, extending between said top and bottom surfaces, the width of said cut-out section at or near the upper surface of said deck being equal to or greater than the width of said cut-out section at or near the bottom surface of said deck, said deck cut-out section forming a cradle for receiving said cylindrical article, said deck cut-out section extending in a direction substantially perpendicular to said first runner and second runner for the length of said cylindrical article.

5. The pallet of claim 4 wherein said first runner and said second runner extend for substantially the length of said deck, said bottom edge of said first runner and said bottom edge of said second runner each having a first notch and a second notch, said notches being adapted to accommodate a strapping means for further securing said cylindrical article.

6. The pallet of claim 5 wherein three runners are provided and said third runner is attached to said bottom surface of said deck, said third runner being in a spaced parallel relationship between said first runner and said second runner.

7. The pallet of claim 4 wherein said deck is comprised of wood planks attached perpendicularly to said first runner and said second runner.

8. The pallet of claim 4 wherein said deck cut-out section extends for the width of said deck.

9. The pallet of claim 8 wherein said deck cut-out section is comprised of two longitudinal edges extending the length of said deck cut-out and being formed such that said edges form an angle substantially perpendicular to the radius of a cylindrical article positioned in said deck cut-out section.

10. The pallet of claim 9 wherein said cut-out section is approximately two inches wide and extends for the width of said deck.

11. The pallet of claim 8 wherein said deck cut-out section is comprised of two longitudinal curved edges formed into said deck, said longitudinal edges extending the length of said deck cut-out and being formed on a curve, said deck cut-out section for receiving a cyclindrical article having a radius substantially equal to said curve.

12. The pallet of claim 8 wherein said top edge of each of said first runner and said second runner includes a runner cut-out section for receiving said cylindrical article, said runner cut-out section located beneath said deck cut-out section, said runner cut-out section further forming said cradle for securing said cylindrical article.

13. The pallet of claim 4 wherein said wooden deck is formed form wood planks.

14. The pallet of claim 4 wherein said cut-out section is shallow.

15. A pallet system comprising:

at least one roll of material wound in a roll having a cylindrical core, said roll being cylindrical shaped and having a diameter, radius and length;

a strap for insertion through said cylindrical core of said roll; and a pallet, said roll being disposed on said pallet, said pallet comprising:

a first runner and a second runner, said first runner and said second runner being spaced in a substantially parallel relationship, each of said first runner and said second runner having a top edge and a bottom edge, each of said bottom edges of said first runner and said second runner having a first notch proximal to a first end of said runners and a second notch proximal to a second end of said runners, said first notch and said second notch for receiving said strap, whereby said strap forms a safe banding angle when inserted through said cylindrical core for securing said roll to said pallet; and a wooden planar deck having a wooden bottom surface attached to said top edges of said first runner and said second runner, said deck having a planar wooden top surface spaced from said bottom surface and substantially parallel thereto, said deck having a deck cut-out section cut into said upper surface of said deck extending between said top and bottom surfaces, the width of said cut-out section at or near the upper surface of said deck being equal to or greater than the width of said cut-out section at or near the bottom surface of said deck, said deck cut-out section forming a cradle for receiving and securing said roll, said deck cut-out section extending in a direction parallel to said cylindrical core and perpendicular to said first runner and said second runner for the length of said roll.

16. The pallet system of claim 15 wherein said first notch and said second notch of said first runner and said second runner are spaced at a distance approximately equal to the diameter of said roll, said first notch and said second notch of each of said runners located equidistant from said cylindrical core of said roll.

17. The pallet system of claim 16, wherein a plurality of said rolls are disposed on said pallet, said cylindrical cores of respective said rolls collectively defining a common cylindrical core, and wherein said first notch and said second notch of each of said runners are spaced at a distance approximately equal to the largest diameter of said plurality of rolls, said first notch and said second notch of each of said runners located equidistant from said common cylindrical core of said plurality of cylindrical rolls, whereby said notches provide a safe banding angle when a strap is secured through the common cylindrical core of the plurality of cylindrical articles and each of the runner notches.

18. The pallet system of claim 15 wherein said wooden deck is formed from wood planks.

19. The pallet system of claim 15 wherein said cut-out section is shallow.

20. A pallet for transporting and storing at least one cylindrical article having a given diameter, radius and length, said cylindrical article further having a cylindrical core, said pallet comprising:

a plurality of runners, said runners being spaced apart in a parallel or substantially parallel relationship, each of said runners having a top edge and a bottom edge; and a wooden planar deck having a wooden bottom surface attached to said top edge of said runners, said deck having a planar wooden top surface spaced from said wooden bottom surface and substantially parallel thereto, said deck further having a wooden cradle for receiving said cylindrical article, said cradle formed into said wooden deck and below the wooden top surface of said deck and extending in a direction perpendicular or substantially perpendicular to said runners, the width of said cradle at or near the upper surface of said deck being equal to or greater than the width of said cradle at or near the bottom surface of said deck.

21. The pallet of claim 20 wherein said wooden deck is formed from wood planks.

22. The pallet of claim 20 wherein said cradle is shallow.

23. A pallet for transporting and storing at least one cylindrical article having a given diameter, radius and length, said cylindrical article further having a cylindrical core, said pallet comprising:

a first runner and a second runner, said first runner and said second runner being spaced apart in a parallel or substantially parallel relationship, each of said first runner and said second runner having a top edge and a bottom edge; and a wooden planar deck having a wooden bottom surface attached to said top edge of said first and second runners, said deck having a planar wood top surface spaced from said bottom surface and substantially parallel thereto, said deck further having a wooden cradle for receiving said cylindrical article, said cradle formed into said wooden deck and below the top surface of said deck, and extending in a direction perpendicular or substantially perpendicular to said runners.

24. The pallet of claim 23 wherein said cradle is formed by a deck cut-out section.

25. The pallet of claim 23 wherein said first runner and said second runner extend for substantially the length of said deck, said bottom edge of said first runner and said bottom edge of said second runner each having one or more first notches and one or more second notches spaced apart, said notches being adapted to accommodate a strapping means for further securing said cylindrical article to said pallet.

26. The pallet of claim 23 wherein said wooden deck is formed from wood planks.

27. The pallet of claim 23 wherein said cradle is shallow.

28. A pallet system comprising:

a pallet comprising a first runner and a second runner, said first runner and said second runner being spaced in a parallel or substantially parallel relationship, each of said first runner and said second runner having a top edge and a bottom edge, each of said bottom edge of said first runner and said second runner having at least one first notch proximal to a first end of said runners and at least one second notch proximal to a second end of said runners; and a wooden planar deck having a wooden bottom surface attached to said top edges of said first runner and said second runner, said deck having a planar wooden ton surface spaced from said bottom surface and substantially parallel thereto, said deck having a cradle formed into said wooden deck and below the wooden top surface of said deck, the width of said cradle at or near the upper surface of said deck being equal to or greater than the width of said cradle at or near the bottom surface of said deck and extending in a direction perpendicular or substantially perpendicular;

at least one roll having a cylindrical core, said roll being positioned on said pallet, in said cradle; and a tying means for securing said roll to said pallet, said tying means being inserted through said core and at least one of each of said first notches and at least one of said second notches.

29. The pallet system of claim 28 wherein said deck further comprises an opening associated with at least one of said first notches and at least one of said second notches, said opening together with associated said notch are adapted to accommodate said tying means for further securing said cylindrical roll to said pallet.

30. The pallet system of claim 28 wherein said pallet system wherein said wooden deck is formed from wood planks.

31. The pallet system of claim 28 wherein said cradle is shallow.

* * * * *